US007045732B1

(12) United States Patent
Hsu

(10) Patent No.: US 7,045,732 B1
(45) Date of Patent: May 16, 2006

(54) PULL RETAINER EMERGENCY SAFETY SWITCH

(75) Inventor: Kuang Hui Hsu, Chung-Ho (TW)

(73) Assignee: Highly Electric Co., Ltd., Chung-Ho (TW)

( * ) Notice: Subject to any disclaimer, the term of this patent is extended or adjusted under 35 U.S.C. 154(b) by 0 days.

(21) Appl. No.: 10/996,384

(22) Filed: Nov. 26, 2004

(51) Int. Cl.
*H01H 9/20* (2006.01)

(52) U.S. Cl. ..... 200/334; 200/341

(58) Field of Classification Search ..... 200/331, 200/334, 329, 341, 520
See application file for complete search history.

(56) References Cited

U.S. PATENT DOCUMENTS 3,801,767 A * 4/1974 Marks ..... 200/543
4,364,556 A * 12/1982 Otte ..... 482/4
4,426,075 A * 1/1984 Otte ..... 482/4
4,454,392 A * 6/1984 Rapp et al. ..... 200/61.67
6,930,267 B1 * 8/2005 Chou ..... 200/520

* cited by examiner

*Primary Examiner*—Michael Friedhofer
*Assistant Examiner*—Lisa Klaus

(57) ABSTRACT

A pull retainer emergency safety switch includes a plastic housing and a switch module, wherein, the plastic housing has a push block device and a pull retainer piece has a ring retainer. The ring retainer abuts on a rotating handle configured in an upper portion of the push block device, and causes an underside of the rotating handle to abut on a triangular push block, and a bottom surface of the triangular push block is utilized to abut on a top surface of another triangular push block, thereby enabling a side surface of the second triangular push block to abut upon a push button of the switch module. When pulling on the pull retainer pieces the rotating handle with an anticlockwise rotating force produced that actuates the triangular push block and enables a horizontal displacement thereby pressing the switch module to actualize rapid cutting off of power supply.

5 Claims, 9 Drawing Sheets

PULL RETAINER EMERGENCY SAFETY SWITCH

BACKGROUND OF THE INVENTION (a) Field of the Invention

The present invention relates to a pull retainer emergency safety switch, and more particularly to an emergency stop safety switch that can be configured on machinery or exercise equipment and employed upon a critical situation arising, whereby, pulling on a pull retainer piece rapidly cuts off power supply, and thereby achieves objective of immediate stoppage of the machinery or exercise equipment.

(b) Description of the Prior Art

An emergency stop safety switch as commonly used in machinery or exercise equipment utilizes either a push-button or pull configuration. Referring to FIGS. 1A and 1B, a push-button emergency stop safety switch a has a switch module a2 configured interior of a housing a2, and utilizes pressing of a push-button all configured on an upper portion of the housing a1 to activate the switch module a2 (see FIG. 1A). Another emergency stop safety switch a having the pull configuration has a switch module a2 configured interior of a housing a1 (see FIG. 1B), moreover, an opening a12 is defined at an appropriate position in the housing a1 to provide for inserting an insertion handle a13 thereinto and thereon into a slot of corresponding shape. Upon employing a front end of the insertion handle a13 to insert into the opening a12, the switch module a2 configured interior of the housing a1 is thus activated. The two different methods of activating the switch modules a2 of the two aforementioned emergency stop safety switches provide for cutting off electric power to a power supply facility. However, upon a critical situation arising in the machinery that utilizes the switch adopting the push-button configuration, because first reaction of a user is to immediately distance oneself from the machinery or the exercise equipment for safety reasons, the user is thus unable to eliminate obstruction on first instance of the critical situation arising, and is only able to look on at a distance from the machinery or exercise equipment being damaged or stay by the machinery or exercise equipment and confront the critical situation. Furthermore, the switch module a2 configured interior of the pull switch has two sets of electric terminals and corresponding contact connecting bars. Wherein, upon contact welding occurring between the electric terminals and the contact connecting bars, because the contact connecting bars are not provided with a force disengagement structure, thus the two sets of contact connecting bars make simultaneous contact with the two sets of electric terminals, which results in damage to the switch module. A spring is configured on a bottom portion of an actuator used to configure the contact connecting bars, and the switch module a2 adopts a negative mode operating method, whereby the actuator is pressed down to compress the spring, which thereby effectuates closing of an open circuit. Thus, after being used for a long period of time or after contact welding of the contact points, fatigue in flexibility of the spring results or a condition possibly occurs whereby the spring splits, and upon the actuator being released, ineffectual disengagement of the contact connecting bars from the electric terminals still results, thereby causing a critical situation to arise.

Hence, the inventor of the present invention utilizes a previously particularly designed emergency safety switch, and provides the emergency safety switch with a specially designed plastic housing and an additional redesigned switch module configured interior thereof, wherewith effectuates rapid cutting off of power supply at a time when a critical situation arises, thereby providing machinery or equipment having the switch module configured thereon to achieve immediate stoppage in an emergency. Moreover, the switch module conforms to design safety regulations, and has superior reliability, thus preventing damage to machinery or equipment from occurring because of inappropriate human operation.

SUMMARY OF THE INVENTION

In light of aforementioned shortcomings of a conventional configuration, the inventor of the present invention, having accumulated years of experience in related arts, attentively and circumspectly carried out extensive study and exploration to ultimately design a completely new structure for a pull retainer emergency safety switch.

A primary objective of the present invention is to provide an emergency stop safety switch that utilizes a pull method to effectuate rapid cutting off of power supply, and thereby achieve objective of immediate stoppage of machinery or exercise equipment.

Another objective of the present invention is to provide a switch module that conforms to design safety regulations for use in cutting off power, which not only guarantees reliability of the switch module, but also prevents damage to machinery or exercise equipment from occurring because of inappropriate human operation.

In order to achieve the aforementioned objectives, the pull retainer emergency safety switch of the present invention is primarily structured to comprise a plastic housing and a switch module. The plastic housing comprises a push block device and a pull retainer piece, wherein the push block device is configured interior of an opening of the housing, and a ring retainer is configured on a front end of the pull retainer piece. The ring retainer correspondingly abuts on a rotating handle configured in an upper portion of the push block device. The rotating handle is provided with lugs and a pin connecting portion, moreover, an outer side wall of the pin connecting portion is provided with a locating hole, and the locating hole is utilized to correspondingly catch onto a locating column disposedly configured on a bottom portion of the plastic housing. A lower portion of the lugs of the rotating handle abuts on a triangular push block, and a bottom surface of the triangular push block further abuts on a top surface of another triangular push block, thereby enabling a side surface of the second triangular push block to directly abut upon a push button of the switch module. Furthermore, the switch module comprises an insulated body interior of which is configured an actuator and two sets of electric terminals, wherein the electric terminals are respectively configured on an upper portion and a lower portion of an inner side of the insulated body. Contact points of the two sets of electric terminals face toward a central portion of the insulated body, and two sets of contact connecting bars penetrate and are thereby configured interior of the actuator. Contact points of the upper contact connecting bars face upward toward corresponding contact points of the upper electric terminals, while contact points of the lower contact connecting bars face downward toward corresponding contact points of the lower electric terminals. A top extremity of the actuator is a push-button, and a spring is configured on a bottom extremity of the actuator.

According to the aforementioned configuration, during usage, the pull retainer piece is inserted into the opening defined in an upper portion of the plastic housing, thereby effectuating flow of an electric current. The ring retainer of the front end of the pull retainer piece thereupon actuates clockwise rotation of the rotating handle of the push block device, and a spring force of the spring interior of the switch module is utilized to actuate forward pushing of the triangular push block that is in contact with the switch module, thereby effectuating upward displacement of the triangular push block above the triangular push block, resulting in staggering of the locating column disposedly configured on the bottom portion of the plastic housing and the locating hole of the outer side wall of the pin connecting portion of the rotating handle, whereupon spring force of a spring is utilized to enable the locating column positioned interior of the spring to sustain continued abutting on the outer side wall of the pin connecting portion of the rotating handle. When a critical situation arises, the pull retainer piece is pulled out, which thereby causes the ring retainer of the front end of the pull retainer piece to actuate anticlockwise rotation of the lugs of the rotating handle of the push block device, which thus actuates the locating column configured on the bottom portion of the plastic housing to catch within the locating hole of the bottom portion of the pin connecting portion of the rotating handle. Upon the rotating handle 11*a* rotating, a displacement force of the lugs of the rotating handle actuates abutting of the triangular push block below the lugs, resulting in downward displacement of the triangular push block, thereby causing the triangular push block to abut and thus push the other triangular push block, engendering a backward pushing action thereof that presses the switch module and power supply is rapidly cut off as a result, thereby achieving objective of immediate stoppage of equipment. A force disengagement mode is adopted between the two sets of electric terminals and contact connecting bars configured interior of the switch module. If contact points on the electric terminals and contact connecting bars should become contact welded, because connecting areas of the actuator and the contact connecting bars are inflexible, not only is effectiveness of force disengagement realized, but should forced disengagement be not realized, the two sets of contact connecting bars on the actuator can still be prevented from making simultaneous contact with the electric terminals and effectuate electric flow thereat, thus achieving objective of protecting circuits interior of the equipment. Furthermore, the switch module of the present invention adopts a positive mode operating method, whereby upon inserting the pull retainer piece, the spring configured interior of the switch module assumes a free slack state, and which allows for electric current to flow to an operating circuit. Upon pulling the pull retainer piece, the push block device produces a pressing force that inwardly compresses the actuator of the switch module, thus causing the spring to assume a compressed state, which effectuates stoppage of the operating circuit. Hence, upon contact welding of the contact points occurring, splitting of the spring or loss of flexibility in the spring happens, not only is reliability of the switch module enhanced, moreover, damage is prevented from occurring to machinery or equipment because of inappropriate human operation, and immediate stoppage of operating equipment is realized under any circumstances.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1A:
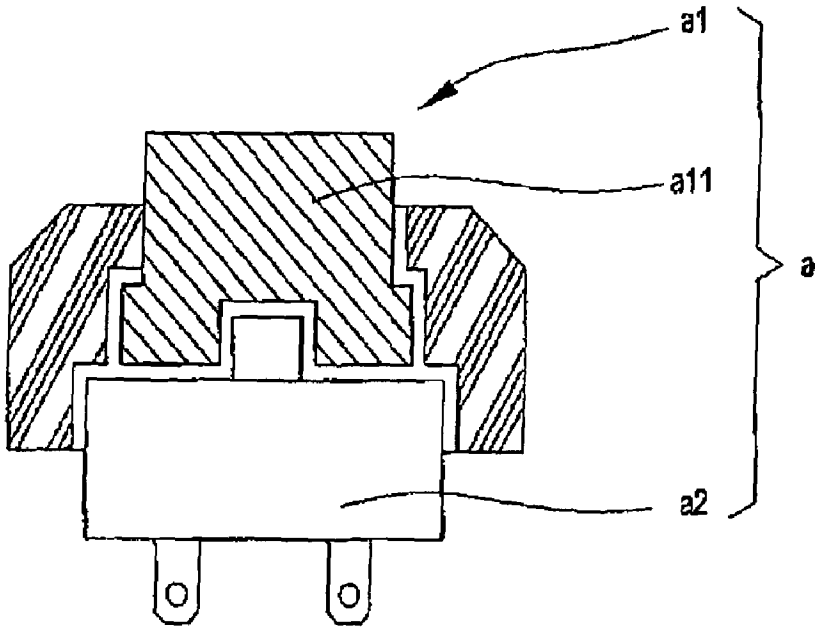
FIG. 1A (PRIOR ART)
FIG. 1A shows a side cutaway view of a conventional push-button emergency stop safety switch.
Figure 1B:
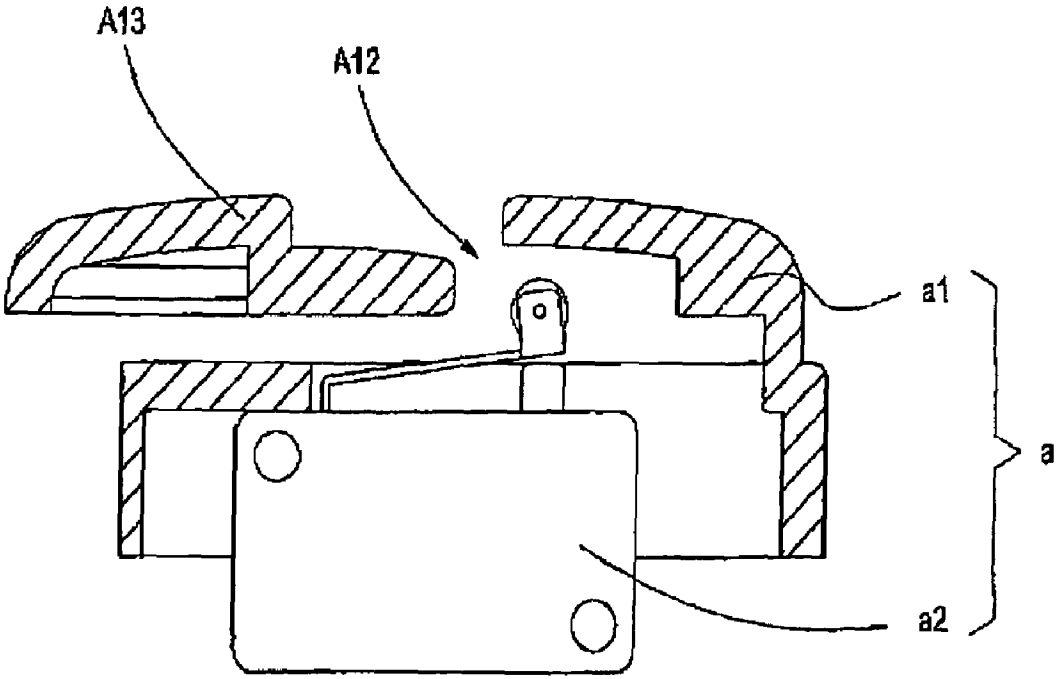
FIG. 1B ( PRIOR ART )
FIG. 1B shows a side cutaway view of a conventional pull emergency stop safety switch.
Figure 2:
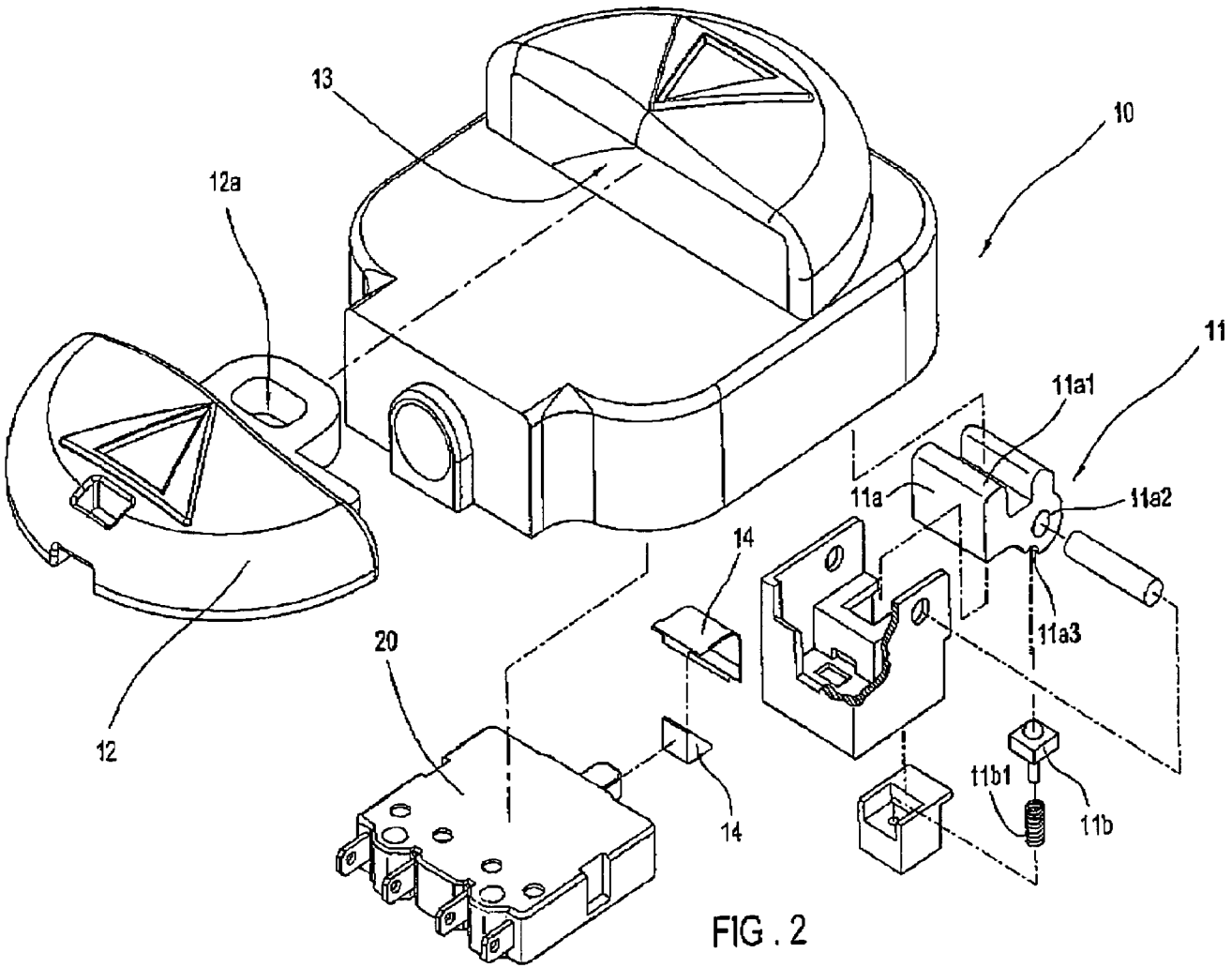
FIG. 2 shows an exploded elevational view according to the present invention.
Figure 3:
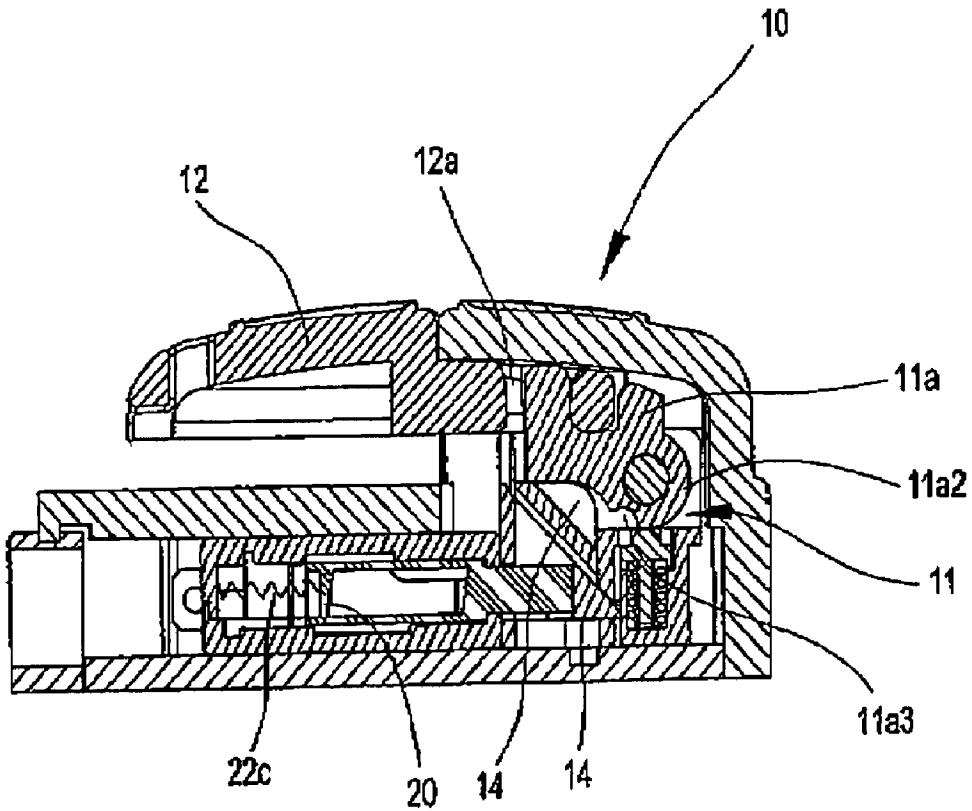
FIG. 3 shows a cross-sectional view of an assembled embodiment according to the present invention.
Figure 4:
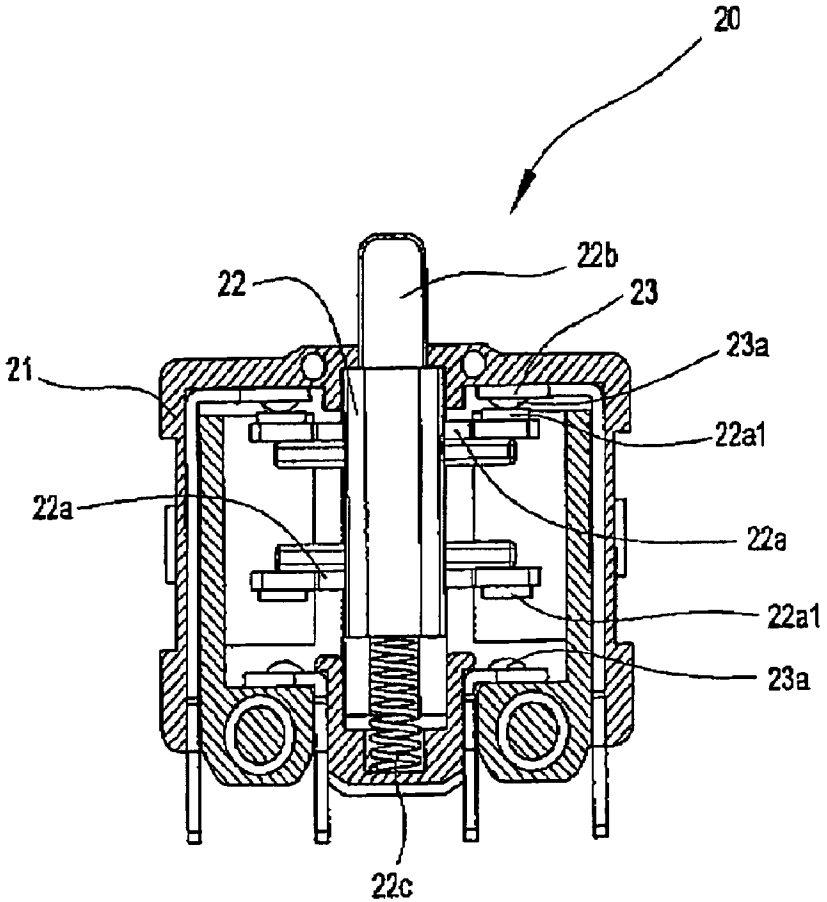
FIG. 4 shows a cross-sectional top view of a switch module according to the present invention.

Referring to FIG. 2, which shows a pull retainer emergency safety switch of the present invention primarily structured to comprise a plastic housing 10 and a switch module 20. The plastic housing 10 comprises a push block device 11 and a pull retainer piece 12, wherein:

The push block device 11 is configured interior of an opening 13 of the housing 10, as depicted in FIG. 3. A ring retainer 12*a* is configured on a front end of the pull retainer piece 12, and the ring retainer 12*a* correspondingly abuts on a rotating handle 11*a* configured in an upper portion of the push block device 11. The rotating handle 11*a* is provided with lugs 11*a*1 and a pin connecting portion 11*a*2, moreover, an outer side wall of the pin connecting portion 11*a*2 is provided with a locating hole 11*a*3, and the locating hole 11*a*3 is utilized to correspondingly catch onto a locating column 11*b* disposedly configured on a bottom portion of the plastic housing 10. A spring 11*b*1 is disposedly configured on a bottom portion of the locating column 11*b*. A lower portion of the lugs 11*a*1 of the rotating handle 11*a* abuts on a triangular push block 14, and a bottom surface of the triangular push block 14 further abuts on a top surface of another triangular push block 14, thereby enabling a side surface of the second triangular push block 14 to directly abut upon the switch module 20. Referring to FIG. 4, which shows an actuator 22 and two sets of electric terminals 23 configured interior of an insulated body 21 of the switch module 20, wherein the electric terminals 23 are respectively configured on an upper portion and a lower portion of an inner side of the insulated body 21. Respective contact points of the two sets of electric terminals 23 face toward a central portion of the insulated body 21, and two sets of contact connecting bars 22*a* penetrate and are thereby configured interior of the actuator 22. Contact points 22*a*1 of the upper contact connecting bars 22*a* face upward toward corresponding contact points 23*a* of the upper electric terminals 23, while contact points 22*a*1 of the lower contact connecting bars 22*a* face downward toward corresponding contact points 23*a* of the lower electric terminals 23. A top extremity of the actuator 22 is a push-button 22*b*, and a spring 22*c* is configured on a bottom extremity of the actuator 22.

Figure 5A:
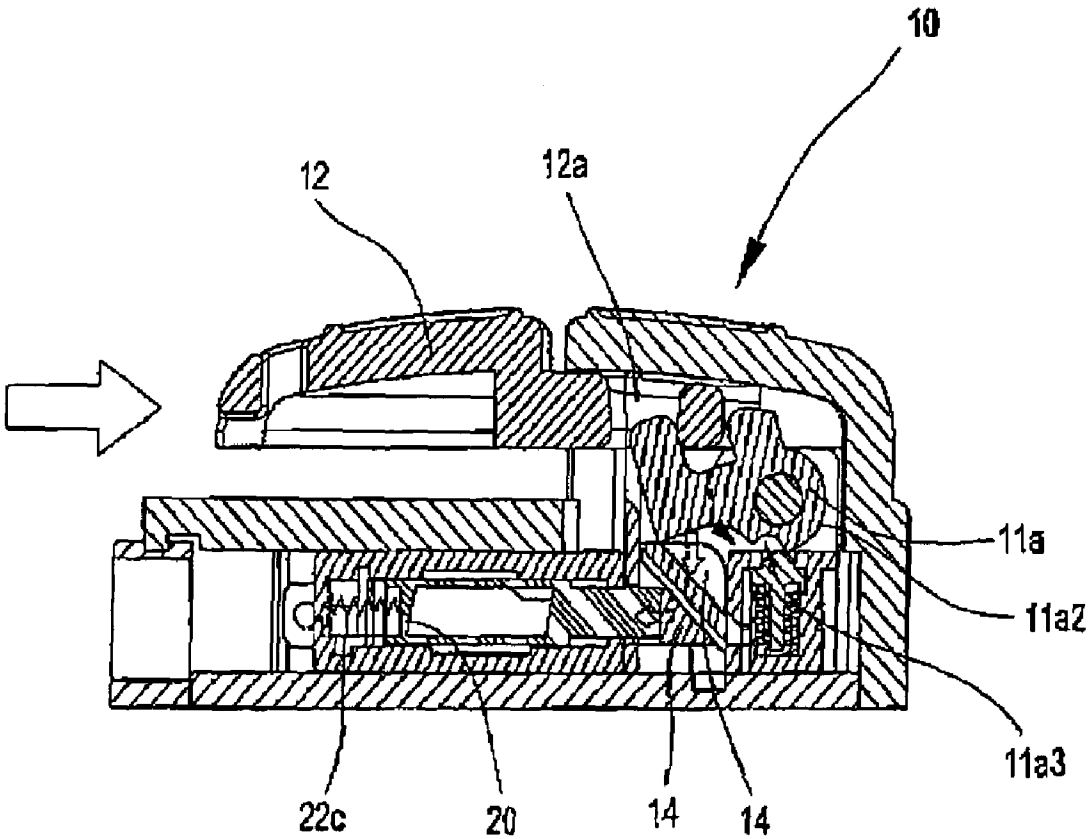
FIG. 5A shows a schematic view of the embodiment in use according to the present invention (1).
Figure 5B:
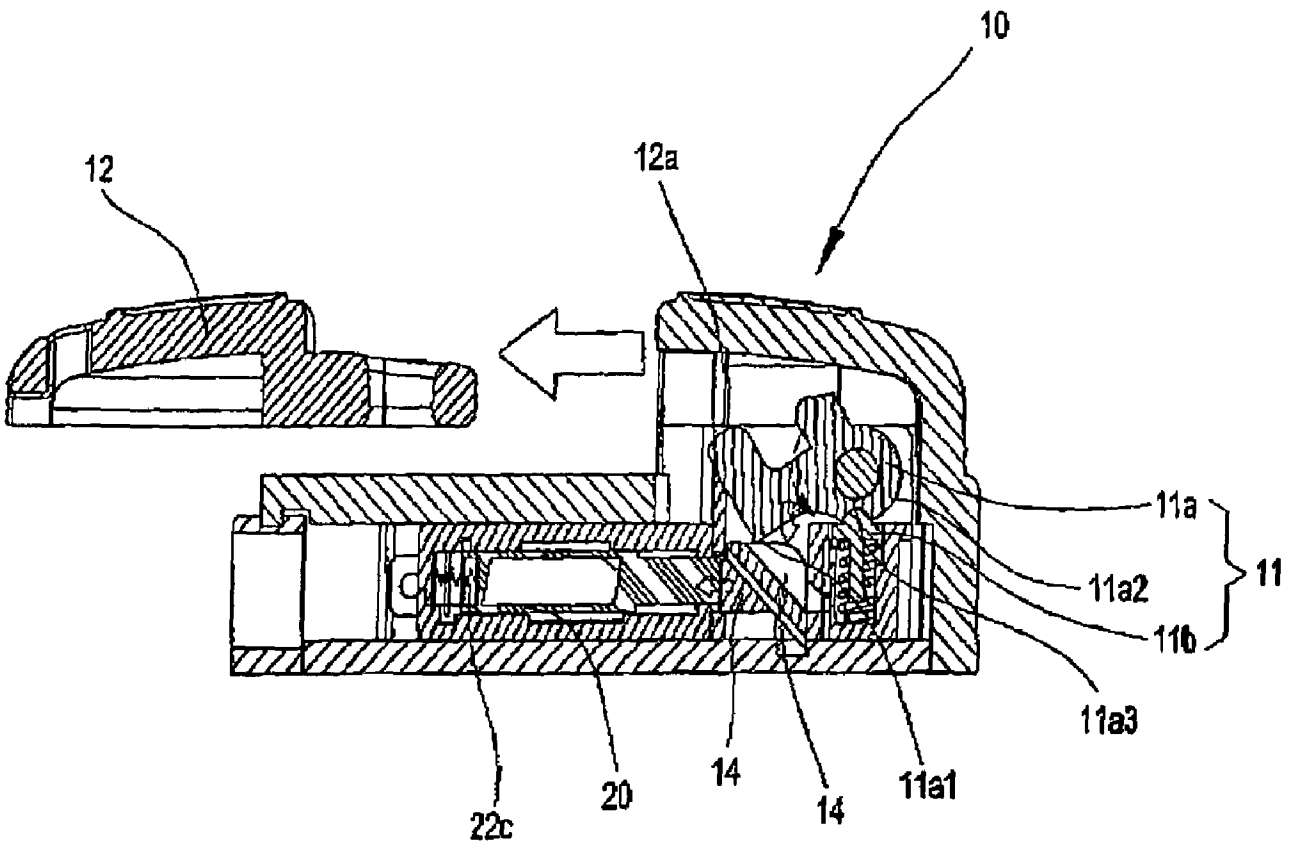
FIG. 5B shows a schematic view of the embodiment in use according to the present invention (2).

Referring to FIGS. 5A, 5B, which show schematic views of the present invention in use. During usage, the pull retainer piece 12 is inserted into the opening 13 defined in an upper portion of the plastic housing 10, thereby effectuating flow of an electric current. The ring retainer 12*a* of the front end of the pull retainer piece 12 thereupon actuates clockwise rotation of the rotating handle 11*a* of the push block device 11, and a spring force of the spring 22*c* interior of the switch module 20 is utilized to actuate forward pushing of the triangular push block 14 that is in contact with the switch module 20, thereby effectuating upward displacement of the triangular push block 14 above the triangular push block 14, resulting in staggering of the locating column 11*b* disposedly configured on the bottom portion of the plastic housing 10 and the locating hole 11*a*3 of the outer side wall of the pin connecting portion 11*a*2 of the rotating handle 11*a*, whereupon a spring force of the spring 11*b*1 is utilized to enable the locating column 11*b* positioned interior of the spring 11*b*1 to sustain continued abutting on the outer side wall of the pin connecting portion 11*a*2 of the rotating handle 11*a*. When a critical situation arises, the pull retainer piece 12 is pulled out, which thereby causes the ring retainer 12*a* of the front end of the pull retainer piece 11 to actuate anticlockwise rotation of the lugs 11*a*1 of the rotating handle 11*a* of the push block device 11, which thus actuates the locating column 11*b* configured on the bottom portion of the plastic housing 10 to catch within the locating hole 11*a*3 of the bottom portion of the pin connecting portion 11*a*2 of the rotating handle 11*a*. Upon the rotating handle 11*a* rotating, a displacement force of the lugs 11*a*1 of the rotating handle 11*a* actuates abutting of the triangular push block 14 below the lugs 11*a*1, resulting in downward displacement of the triangular push block 14, thereby causing the triangular push block 14 to abut and thus push the other triangular push block 14, engendering a backward pushing action thereof that presses the switch module 20 and power supply is cut off as a result, thereby achieving objective of immediate stoppage of the machinery.

Figure 6A:
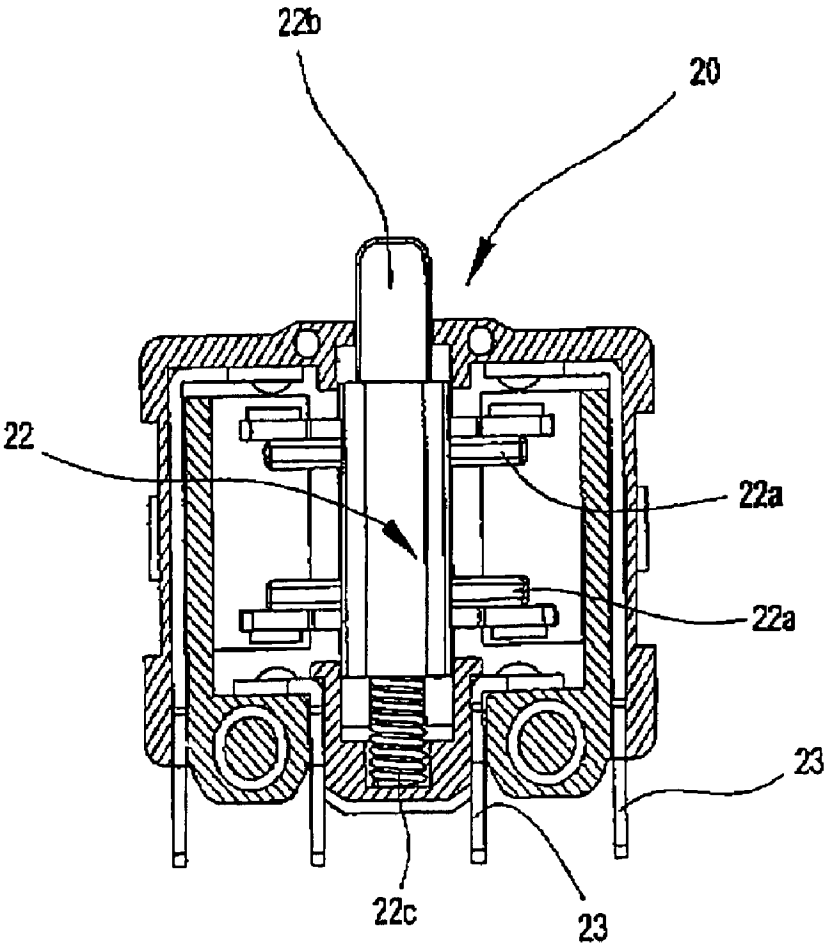
FIG. 6A shows a schematic view of the switch module in operation according to the present invention (1).
Figure 6B:
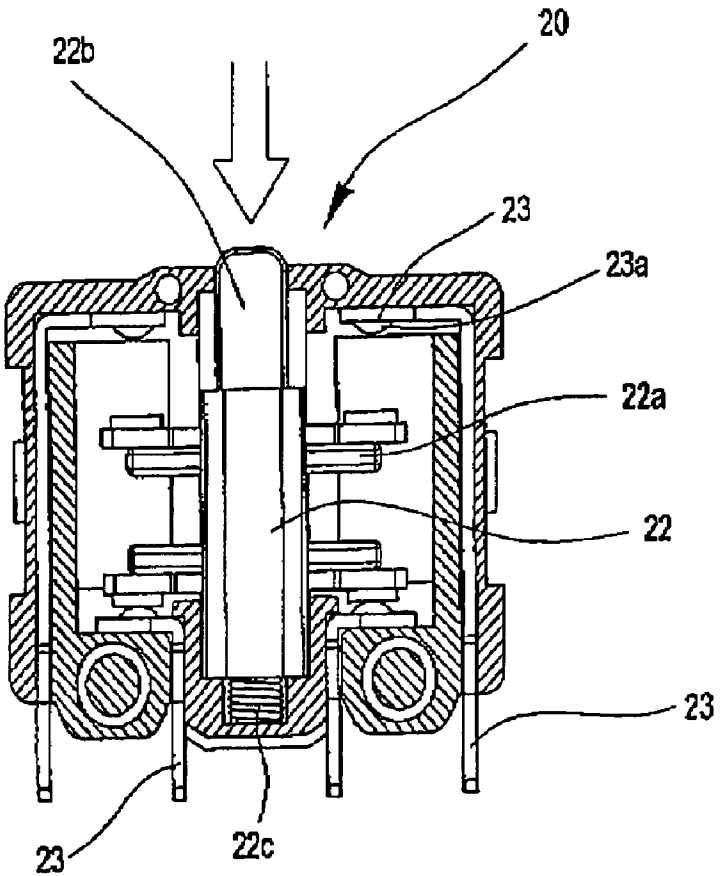
FIG. 6B shows a schematic view of the switch module in operation according to the present invention (2).

Referring to FIGS. 6A and 6B, which show schematic views of the switch module 20 in operation according to the present invention. Upon switching on electric power, the button 22*b* assumes a released state, and the spring 22*c* interior of the switch module 20 is pulled upwards, which thereby effectuates upward displacement of the actuator 22, and the contact connecting bars 22*a* positioned on the upper portion of the actuator 22 are thus made to come in mutual contact with the upper electric terminals 23. While, upon executing an emergency stop, the button 22*b* assumes a pressed down state, and the actuator 22 of the switch module 20 is caused to be inwardly pressed, which results in compressing of the spring 22*c* interior of the switch module 20, and causes the contact connecting bars 22*a* positioned on the lower portion of the actuator 22 to make mutual contact with the lower electric terminals 23.

In conclusion, the pull retainer emergency safety switch of the present invention utilizes a previously designed emergency safety switch, and integrates the emergency safety switch with the switch module 20 configured interior thereof, and such a configuration assuredly effectuates rapid cutting off of power supply therewith, thereby achieving objective of immediate stoppage of equipment. Moreover, structural improvement of the switch module conforms to design safety regulations for use in cutting off power, and is provided with practicability and advancement. Accordingly, a new patent application is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A pull retainer emergency safety switch comprising a plastic housing and a switch module, and characterized in that: the plastic housing comprises a push block device and a pull retainer piece, wherein a ring retainer is configured on a front end of the pull retainer piece, and the ring retainer abuts on a rotating handle configured in an upper portion of the push block device, which causes a lower portion of the rotating handle to abut on a triangular push block, and a bottom surface of the triangular push block is utilized to further abut on a top surface of another triangular push block, thereby enabling a side surface of the second triangular push block to abut upon a push button of the switch module.

2. The pull retainer emergency safety switch according to claim 1, wherein the rotating handle configured on the upper portion of the push block device is provided with lugs and a pin connecting portion, moreover, an outer side wall of the pin connecting portion is provided with a locating hole.

3. The pull retainer emergency safety switch according to claim 2, wherein a locating column is disposedly configured on a bottom portion of the plastic housing, and a spring is disposedly configured on a bottom portion of the locating column; a top extremity of the locating column is utilized to correspondingly catch within the locating hole of the rotating handle.

4. The pull retainer emergency safety switch according to claim 1, wherein a locating column is disposedly configured on a bottom portion of the plastic housing, and a spring is disposedly configured on a bottom portion of the locating column; a top extremity of the locating column is utilized to correspondingly catch within the locating hole of the rotating handle.

5. The pull retainer emergency safety switch according to claim 1, wherein an actuator and two sets of electric terminals are configured interior of an insulated body of the switch module, wherein the electric terminals are respectively configured on an upper portion and a lower portion of an inner side of the insulated body, moreover, respective contact points of the two sets of electric terminals face toward a central portion of the insulated body, and two contact connecting bars penetrate and are thereby configured interior of the actuator; contact points of the upper contact connecting bars face upward toward corresponding contact points of the upper electric terminals, while contact points of the lower contact connecting bars face downward toward corresponding contact points of the lower electric terminals; a top extremity of the actuator is a push-button, and a spring is configured on a bottom extremity of the actuator.

* * * * *